US009668524B2

(12) United States Patent
Harris et al.

(10) Patent No.: US 9,668,524 B2
(45) Date of Patent: Jun. 6, 2017

(54) EXERCISE GARMENTS WITH INTEGRATED LEGWARMERS

(71) Applicant: Color Image Apparel, Inc., Commerce, CA (US)

(72) Inventors: Daniel Harris, Beverly Hills, CA (US); Marco DeGeorge, Santa Monica, CA (US)

(73) Assignee: ALO, LLC, Commerce, CA (US)

( * ) Notice: Subject to any disclaimer, the term of this patent is extended or adjusted under 35 U.S.C. 154(b) by 0 days.

(21) Appl. No.: 14/292,655

(22) Filed: May 30, 2014

(65) Prior Publication Data

US 2015/0342270 A1 Dec. 3, 2015

(51) Int. Cl.

| | |
|---|---|
| ***A41D 1/06*** | (2006.01) |
| ***A41D 1/08*** | (2006.01) |
| ***A41D 17/02*** | (2006.01) |
| ***A41B 11/00*** | (2006.01) |
| ***A41D 13/00*** | (2006.01) |

(52) U.S. Cl.

CPC ..... *A41D 1/06* (2013.01); *A41D 1/08* (2013.01); *A41D 13/0015* (2013.01); *A41B 11/00* (2013.01); *A41D 17/02* (2013.01)

(58) Field of Classification Search

CPC . A41D 1/06; A41D 1/08; A41D 1/084; A41D 15/002; A41D 17/00; A41D 17/02; A41D 1/067; A41D 10/00; A41D 13/0015; A41D 13/0017; A41D 2600/10; A41B 9/04; A41B 9/08; A41B 11/14; A41B 11/00; A41B 11/003; A41B 11/008; A41B 11/08; A41B 11/02

USPC ..... 2/227, 231, 232, 79, 269, 228, 242, 407, 2/409; 36/2 R; D2/747, 742, 712; 450/117

See application file for complete search history.

(56) References Cited

U.S. PATENT DOCUMENTS 405,903 A * 6/1889 North ..... D04B 1/243 2/404
408,438 A * 8/1889 Roper ..... A41B 9/02 2/239

(Continued)

FOREIGN PATENT DOCUMENTS

CH 376074 A 3/1964
CN 201830930 U 5/2011

(Continued)

OTHER PUBLICATIONS

"Item of the Moment: Barre Legging by Prima Studio", SeattleMet, Jan. 13, 2014, 3 pgs. http://www.seattlemet.com/articles/2014/1/13/item-of-the-moment-barre-legging-by-prima-studio-january-2014.*

(Continued)

*Primary Examiner* — Amy Vanatta
(74) *Attorney, Agent, or Firm* — Carr & Ferrell LLP

(57) ABSTRACT

Exercise garments with integrated legwarmers are provided herein. In one embodiment a pair of pants includes an upper segment formed from an elastomeric material and a pair of legwarmers that are each joined to the upper segment, the pair of legwarmers forming a lower segment of the pair of pants, each of the pair of legwarmers having a length, the length of each of the pair of legwarmers being sufficiently long enough to overlap the portion of a foot of a wearer.

17 Claims, 5 Drawing Sheets

(56) References Cited

U.S. PATENT DOCUMENTS

| | | | | | |
|---|---|---|---|---|---|
| 957,893 | A * | 5/1910 | Marville | A41B 11/14 | 2/409 |
| 1,838,022 | A * | 12/1931 | Lieberman | A41D 1/08 | 2/228 |
| 1,869,918 | A * | 8/1932 | Schrank | 2/237 | |
| 1,885,527 | A * | 11/1932 | Luft | 2/227 | |
| 2,299,324 | A * | 10/1942 | Henderson | A41D 1/08 | 2/228 |
| 2,416,857 | A * | 3/1947 | Trinkel | 2/237 | |
| RE23,225 | E * | 5/1950 | Roessner | A41D 1/08 | 2/228 |
| 3,249,110 | A * | 5/1966 | Bryan | A41B 11/12 | 2/409 |
| 3,496,572 | A * | 2/1970 | Herzig | 2/457 | |
| 3,599,241 | A * | 8/1971 | Rossler | D04B 1/243 | 2/240 |
| 4,156,294 | A * | 5/1979 | Horn | A63B 71/12 | 2/239 |
| 4,458,363 | A * | 7/1984 | Harvey | 2/2.11 | |
| 4,506,392 | A * | 3/1985 | White | A41B 11/14 | 2/239 |
| 4,601,066 | A * | 7/1986 | Campbell | 2/70 | |
| 4,625,336 | A | 12/1986 | Derderian | | |
| D290,302 | S | 6/1987 | Campbell | | |
| 4,870,708 | A * | 10/1989 | Staley | A41B 11/02 | 2/404 |
| 5,033,126 | A * | 7/1991 | Wruck et al. | 2/242 | |
| 5,067,179 | A | 11/1991 | Wormser | | |
| 5,182,812 | A * | 2/1993 | Goldsby | 2/79 | |
| 5,241,707 | A * | 9/1993 | Kato | 2/79 | |
| 5,608,915 | A * | 3/1997 | Libit | 2/228 | |
| 5,943,699 | A * | 8/1999 | Barbeau | A41D 1/067 | 2/227 |
| D532,958 | S | 12/2006 | Kent | | |
| D580,126 | S * | 11/2008 | Rieder | D2/742 | |
| D599,982 | S | 9/2009 | Kim | | |
| D616,630 | S * | 6/2010 | Christiansen | D2/742 | |
| D619,784 | S | 7/2010 | Kanada et al. | | |
| D625,490 | S * | 10/2010 | Halpern | D2/742 | |
| D641,134 | S * | 7/2011 | Zarabi | D2/712 | |
| D641,539 | S | 7/2011 | Zarabi | | |
| D668,434 | S * | 10/2012 | Iamartino | D2/742 | |
| D683,107 | S | 5/2013 | McLaren et al. | | |
| D693,989 | S | 11/2013 | Tanaka et al. | | |
| D698,520 | S | 2/2014 | Anderson et al. | | |
| D731,753 | S | 6/2015 | Mahtani | | |
| D741,574 | S | 10/2015 | Michaeloff | | |
| D750,346 | S | 3/2016 | McManus | | |
| 9,301,553 | B1 * | 4/2016 | Donovan | A41D 1/00 | |
| D765,346 | S | 9/2016 | Harris et al. | | |
| 2004/0006811 | A1 | 1/2004 | McKenzie | | |
| 2004/0210989 | A1 * | 10/2004 | Tams | A41B 11/14 | 2/239 |
| 2005/0091729 | A1 * | 5/2005 | Alley | A41B 11/004 | 2/239 |
| 2006/0105658 | A1 * | 5/2006 | Patz | A41D 31/0022 | 442/181 |
| 2014/0115753 | A1 * | 5/2014 | Amburgey | 2/227 | |
| 2014/0143930 | A1 | 5/2014 | Kuraoka et al. | | |
| 2014/0259293 | A1 * | 9/2014 | Ortberg-Wydman | A41D 1/06 | 2/227 |

FOREIGN PATENT DOCUMENTS

| | | | |
|---|---|---|---|
| DE | 2909613 | A1 * | 9/1980 |
| EP | 2991517 | A1 | 3/2016 |
| FR | 1289632 | A | 4/1962 |
| FR | 1460766 | A | 1/1966 |
| WO | WO 2012/039835 | A1 * | 3/2012 |
| WO | WO2015183615 | A1 | 12/2015 |

OTHER PUBLICATIONS

"Mama Says Sew: Ruched Leg Warmers Tutorial", Mama Says Sew Blogspot, Oct. 11, 2013. 5 pgs. http://mama-says-sew.blogspot.com/2013/10/ruched-leg-warmers-tutorial.html.*

"Tutorial: Ruched Leggings (for girls and women)", DanaMadelt.com, Jul. 6, 2008, 18 pgs. http://www.danamadeit.com/2008/07/tutorial-ruched-leggings-for-girls-and-women.html.*

"Bizarre Jeans/Legwarmers/Stirrup Pants Love Triangle", The Fashion Police, http://www.thefashionpolice.net/2008/06/bizarre-jeansle.html ; f Jun. 6, 2008, 1 page.*

Goddess Ribbed Legging. Datasheet [online]. Alo Yoga, 2014 [retrieved on Sep. 8, 2015] Retrieved from the Internet: <URL: http://web.archive.org/web/20140208025300/http://www.aloyoga.com/new-arrivals> and <URL:http://web.archive.org/web/20140209213218/http://www.aloyoga.com/product/w5386r/goddess-ribbed-legging.html> and <URL: http://gypsetgoddess.com/alo-goddess-leggings/>.

International Search Report and Written Opinion mailed Oct. 13, 2015 in Patent Cooperation Treaty Application No. PCT/US2015/031364, filed May 18, 2015.

"Office Action," Canadian Patent Application No. 2895668, May 26, 2016, 6 pages.

"Office Action," Australian Patent Application No. 2015203360, Mar. 24, 2016, 3 pages.

"Office Action," Japan Patent Application No. 2016-524400, Sep. 20, 2016, 17 pages [37 pages including translation].

"Notice of Allowance," Australian Patent Application No. 2015203360, Nov. 15, 2016, 2 pages.

"Extended European Search Report and Written Opinion," European Patent Application No. 15727532.2, Feb. 1, 2017, 10 pages.

"Alo Yoga—New Arrivals. Goddess Ribbed Legging," Alo Yoga [online], Feb. 8, 2014 [retrieved Jan. 20, 2017], Retrieved from the Internet: <URL:http://web.archive.org/web/20140208025300/http://www.aloyoga.com/new-arrivals>, 3 pages.

"Office Action," Canada Patent Application No. 2895668, Mar. 1, 2017, 5 pages.

* cited by examiner

EXERCISE GARMENTS WITH INTEGRATED LEGWARMERS

FIELD OF THE PRESENT TECHNOLOGY

The present technology relates generally to exercise garments, and more specifically, but not by way of limitation, to exercise garment, such as pants that include integrated legwarmers. In some embodiments the legwarmers are sized to extend over at least a portion of the feet of the wearer.

SUMMARY OF THE PRESENT TECHNOLOGY

According to some embodiments, the present technology may be directed to a pair of pants, comprising: (a) an upper segment formed from an elastomeric material; and (b) a pair of legwarmers that are each joined to the upper segment, the pair of legwarmers forming a lower segment of the pair of pants, each of the pair of legwarmers comprising a length, the length of each of the pair of legwarmers being sufficiently long enough to overlap the portion of a foot of a wearer.

According to some embodiments, the present technology may be directed to a pair of pants that comprises: (a) an upper segment formed from an elastomeric material; and (b) a pair of legwarmers that are each joined to the upper segment, the pair of legwarmers forming a lower segment of the pair of pants, each of the pair of legwarmers comprising a length, each of the pair of legwarmers comprising ruching that causes material of each of the pair of legwarmers to gather together and form ripples in the material.

In some embodiments, the pair of legwarmers is fixedly attached to the upper segment using a thigh seam. In other embodiments, the thigh seam is located above the knees of the wearer.

According to some embodiments, the connection seam is located from approximately five inches to approximately seventeen inches relative to a lower seam of the waistband of the upper segment.

In yet other embodiments, a material that comprises each of the pair of legwarmers is attached with an elastic material to create ruching that causes material of each of the pair of legwarmers to gather together and form ripples in the material. In one embodiment the ruching is located along an inside seam or edge of each of the pair of legwarmers.

In some embodiments, the pair of legwarmers and the upper segment mate together at connecting seams.

In one embodiment, the connecting seams are each disposed at an angle relative to an inseam of the upper segment. In another embodiment, the angle causes the connecting seams to slant from an outer edge of each of the pair of legwarmers towards an inner edge of each of the pair of legwarmers.

In some embodiments, the connecting seams are arcuate. In other embodiments, the angle causes the connecting seams to slant from an outer edge of each of the pair of legwarmers towards an inner edge of each of the pair of legwarmers.

In yet other embodiments, each of the pair of legwarmers comprises an inner seam running along its length, wherein the inner seam comprises an elastic material that creates shirring along the inner seam.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1A:
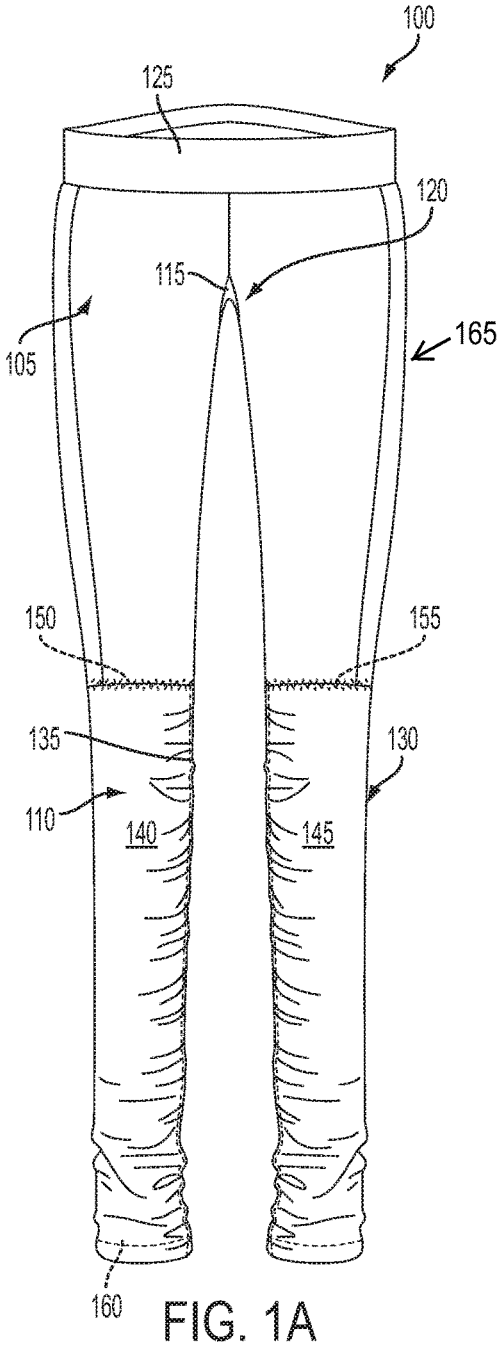
FIG. 1A is a front perspective view of a pair of pants with integrated legwarmers, constructed in accordance with the present technology.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the present technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Broadly described, the present technology contemplates exercise pants that integrate yoga pants with legwarmers or leggings. An upper segment of the pants are created from a nylon/elastane material, while the legwarmers can comprise any one (or combination) of a variety of materials.

Figure 1B:
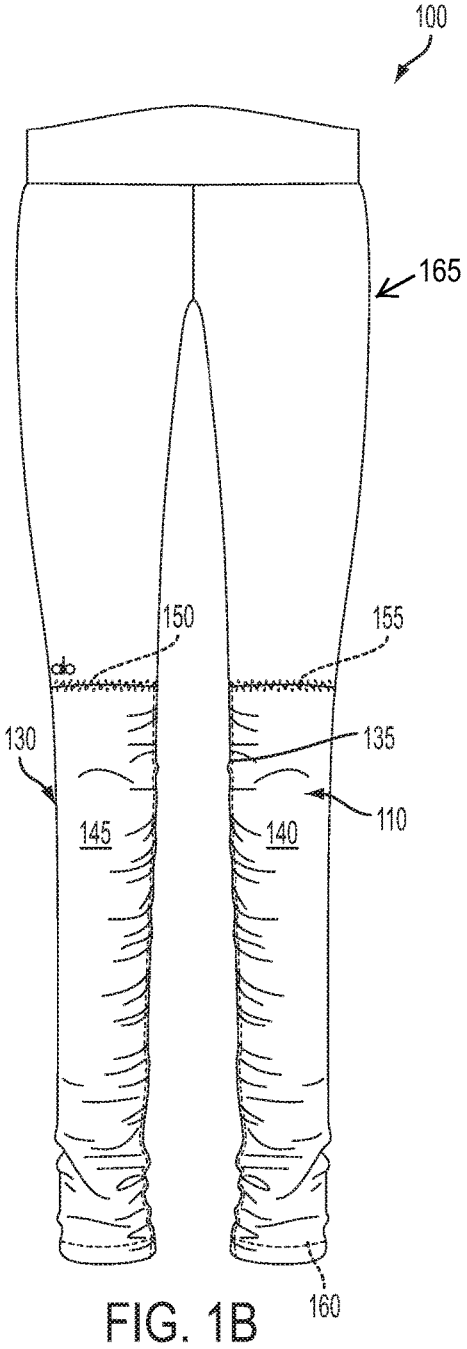
FIG. 1B is a rear perspective view of a pair of pants of FIG. 1A.

FIGS. 1A and 1B collectively illustrate an example pair of pants (garment) 100, constructed in accordance with the present technology. More specifically, FIG. 1A is a front perspective view and FIG. 1B is a rear perspective view.

The pair of pants 100 is comprised of an upper segment 105 and a lower segment 110. Broadly, the upper segment 105 comprises a first material, such as an elastomeric material that is configured to conform to the body, and specifically the lower torso of a wearer. In one non-limiting example, the material for the upper segment 105 is a composite of Nylon and Spandex in a combination of 87% Nylon and 13% Spandex. The elastomeric material can include any suitable material that is used for exercise garments that would be known to one of ordinary skill in the art. The material for the upper segment 105 may, in some embodiment, comprise a triangle gusset 115 (reference number 550 in FIG. 5A) that is positioned proximately a front rise 120 of the upper segment 105. In other embodiments, the front rise 120 includes a flat lock seam or a straddle stitch.

The upper segment 105 also includes a waistband 125 (reference 540 in FIG. 5A) that is provided at the top edge of the upper segment 105. Further, the upper segment 105 can have an inseam 135 and at least one outseam 165.

Figure 2A:
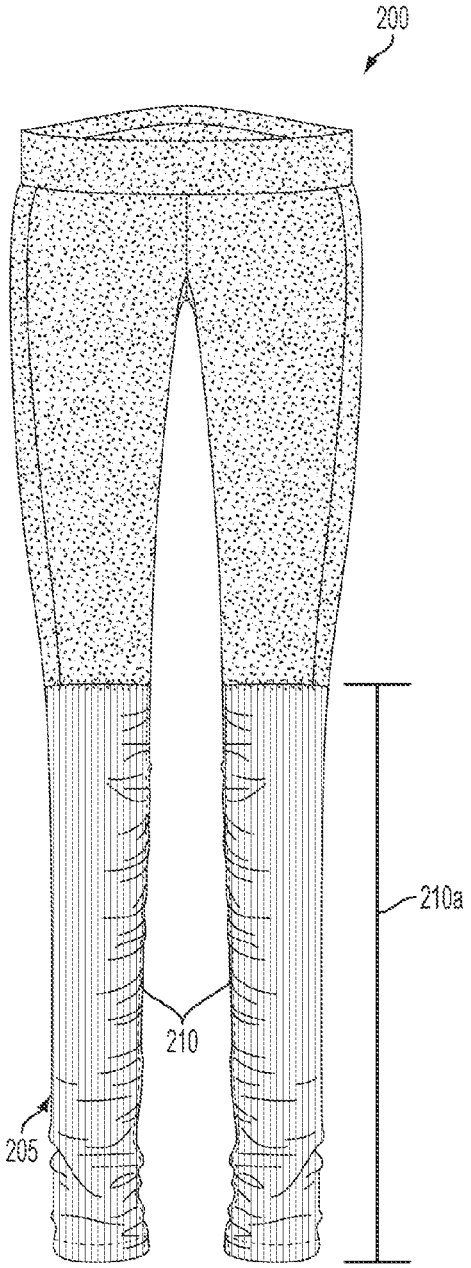
FIG. 2A is a front elevational view of a pair of pants with integrated legwarmers, wherein the integrated legwarmers exhibit shirring.

The lower segment 110 comprises a pair of legwarmers 130 that are joined to the upper segment 105 in a variety of manner, which will be described in greater detail below. As examples, FIG. 2A illustrates an example pair of pants 200 having a pair of legwarmers 205 that create vertically arranged gatherings 210 that extend along a length 210*a* of each of the legwarmers. These vertically arranged gatherings are created by a seam or stitching process referred to as shirring. In general, shirring is caused when a specific stitch pattern is used with an elastic material on the inseam of the leg warmer portions 140, 145 of the pants 200. Shirring can also occur at the seam that attaches each of the legwarmers to the upper segment 105, also referred to as connection seams.

Figure 2B:
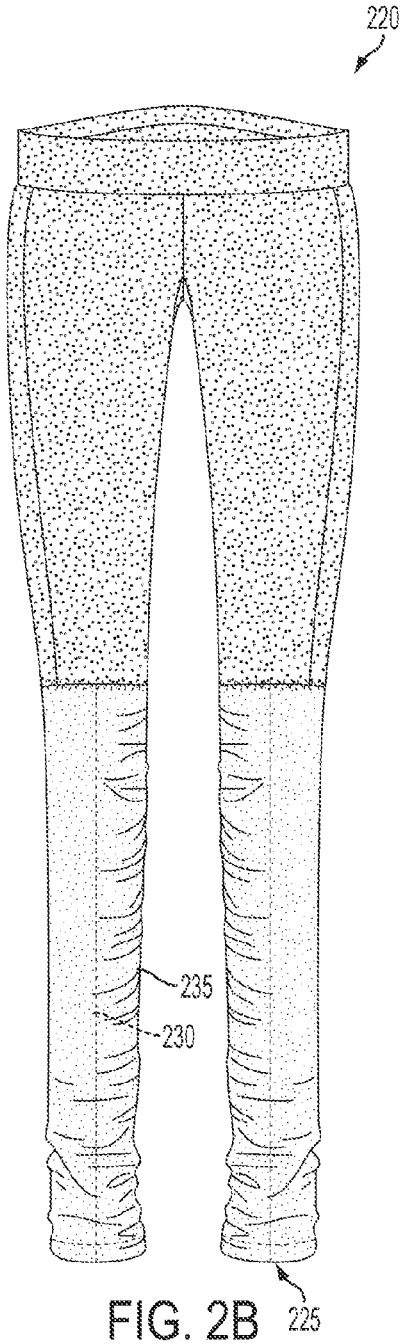
FIG. 2B is a front elevational view of a pair of pants with integrated legwarmers, wherein the integrated legwarmers exhibit ruching.

FIG. 2B illustrates an example pair of pants 220 having a pair of legwarmers 225 that create gatherings 235 that extend the length 230 of each of the legwarmers. These gatherings are created by a seaming process referred to as ruching. In general, ruching is caused when an elastic material is stretched and affixed to the inseam 135 of each of the legwarmers. When the elastic material is released, it forms the gatherings, or ruching.

Referring again to FIGS. 1A and 1B, in some embodiments, the pair of legwarmers comprises a first legwarmer 140 and a second legwarmer 145 that are each attached to the upper segment 105 at connection seams 150 and 155, respectively. The legwarmers each comprise a second material, such as a cotton or cotton blend textile, or nylon spandex or the like. In other embodiments the legwarmers can be fabricated from a material that is similar to the material used for the upper segment 105, but the second material used for the legwarmers is visually distinct from that of the upper segment 105 due to specific types of knitting patterns, as mentioned above.

The connection seams 150 and 155 may comprise any type of connecting seam. In some non-limiting examples, the connection seams 150 and 155 include flat lock seams. Another example includes straddle seams.

In some embodiments, it is preferable for the connection seams 150 and 155 to be located such that they are positioned above the knee of the wearer. Because the pants 100 can be created in various sizes and the physical proportions of the wearers may be different from one another, the exact location of the connection seams 150 and 155 may vary according to the size of the pants 100. For example, the exact location of the connection seams 150 and 155 for pants that are designed for individuals that are shorter than six feet tall might be different from the location of the connection seams 150 and 155 for pants that are designed for individuals that are taller than six feet tall. One of ordinary skill in the art will appreciate that common sizes for exercise pants, such as xxsmall, xsmall, small, medium, large, extra large, and so forth, are generally each sized to fit ranges of differently sized individuals. These general size differences can be used as a baseline for determining or estimating the placement of the connection seams such that they are positioned above the knee of the wearer.

Figure 3:
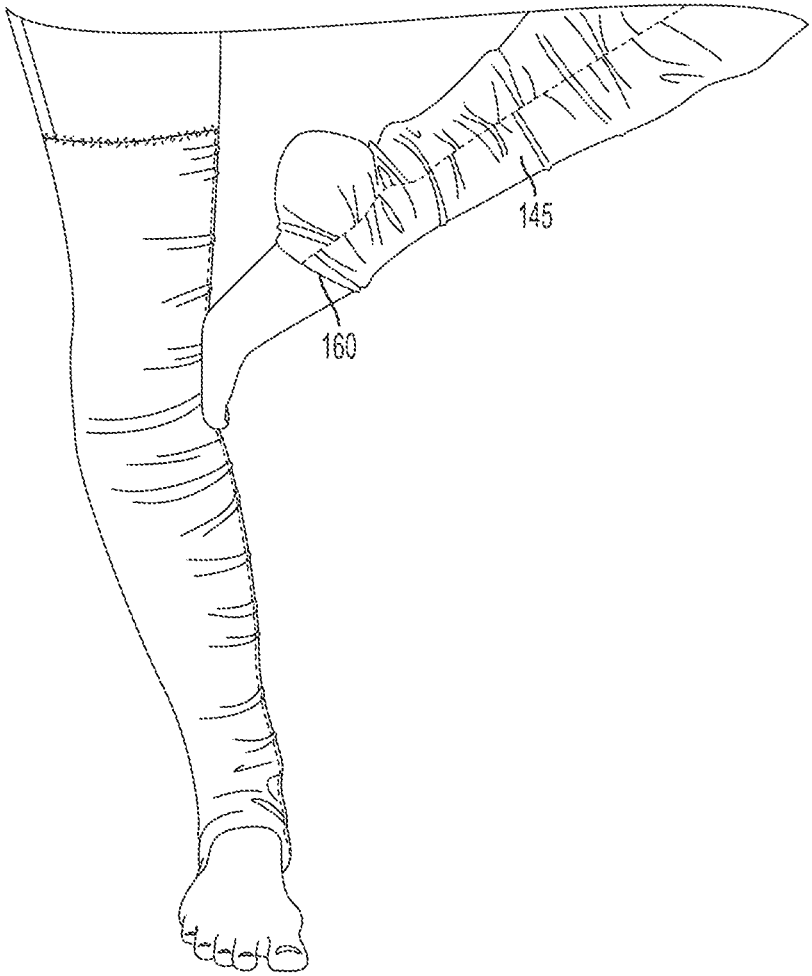
FIG. 3 is a perspective view of a pair of pants with integrated legwarmers, illustrating a portion of one of the pair of legwarmers overlapping a portion of a foot.

In some embodiments, the first legwarmer 140 and the second legwarmer 145 each comprise a length that is configured to allow a wearer to overlap at least a portion of their feet with the ends of the legwarmers. FIG. 3, FIG. 1A, and FIG. 1B illustrate a terminal end 160 of the second legwarmer 145 as overlapping a heel of a foot of the wearer. When the terminal end 160 overlaps the foot, it provides, for example, an anti-slip surface for the wearer. Also, as depicted in the exemplary embodiment of FIG. 3, the legwarmers of the lower portion may have only one vertical seam consisting of an inseam.

While the terminal end 160 has been described as being configured to overlap the heel of a foot, the legwarmers may be sized to allow their terminal ends to overlap the foot up to the toes of the foot as well. Advantageously, the legwarmers can be pulled up from around the feet of the wearer such that the terminal end of each legwarmer is above the ankle of the wearer. The extra length required to allow the legwarmers to overlap the foot will function to enhance the gathering (ruching) of the fabric of the legwarmers when the rib of each legwarmer is above the ankle of the wearer.

As with the location of the connection seams, in some embodiments, the length of each of the legwarmers is sufficient to ensure that the material of the legwarmers gathers, at least slightly, to create a distinct visual appearance of bunching or rippling of the material of the legwarmers. Again, the exact or estimated length of the legwarmers is based upon target sizes such as xxsmall, xsmall, small, medium, large, and so forth.

Figure 4:
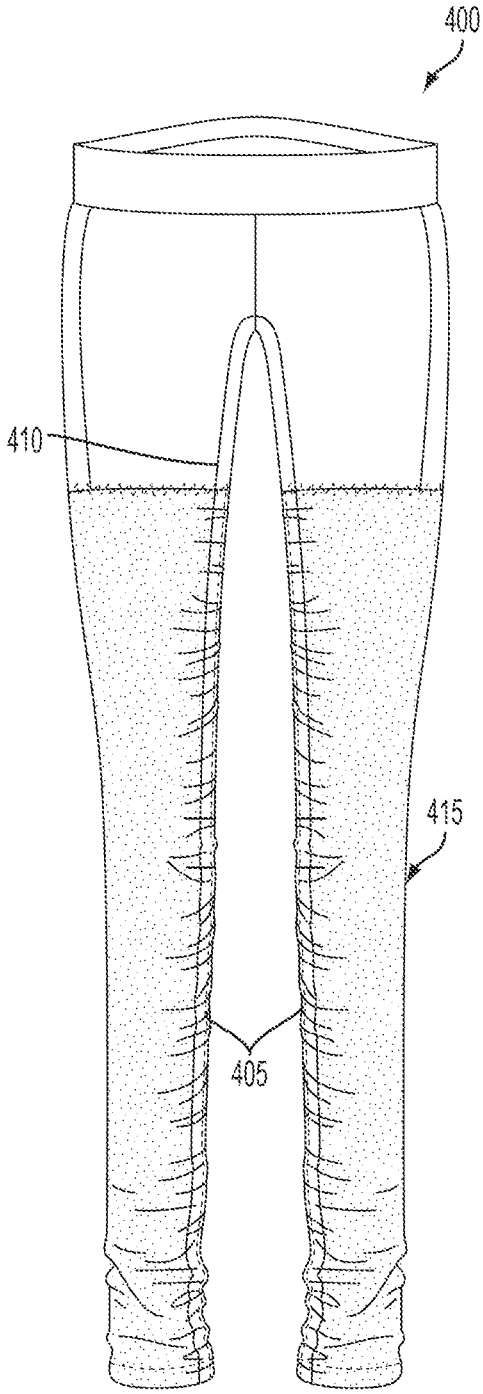
FIG. 4 is a front perspective view of a pair of pants with integrated legwarmers, illustrating an inside panel and join seam with elastic material that creates ruching on the integrated legwarmers.

FIG. 4 illustrates another embodiment of a pair of pants 400 that are constructed similarly to the pants 100 of FIGS. 1A and 1B with the pants 400 including a strip of material 405 that is disposed along at least a portion of an inner join seam 410 of the pants 400. The strip of material 405 can be formed from, for example, a mesh material or other material that is attached to an elastic material to create ruching of the material of the legwarmers 415. That is, the elastic material causes bunching or gathering of the legwarmer material along the peripheral edge of the inner join seam 410.

Figure 5A:
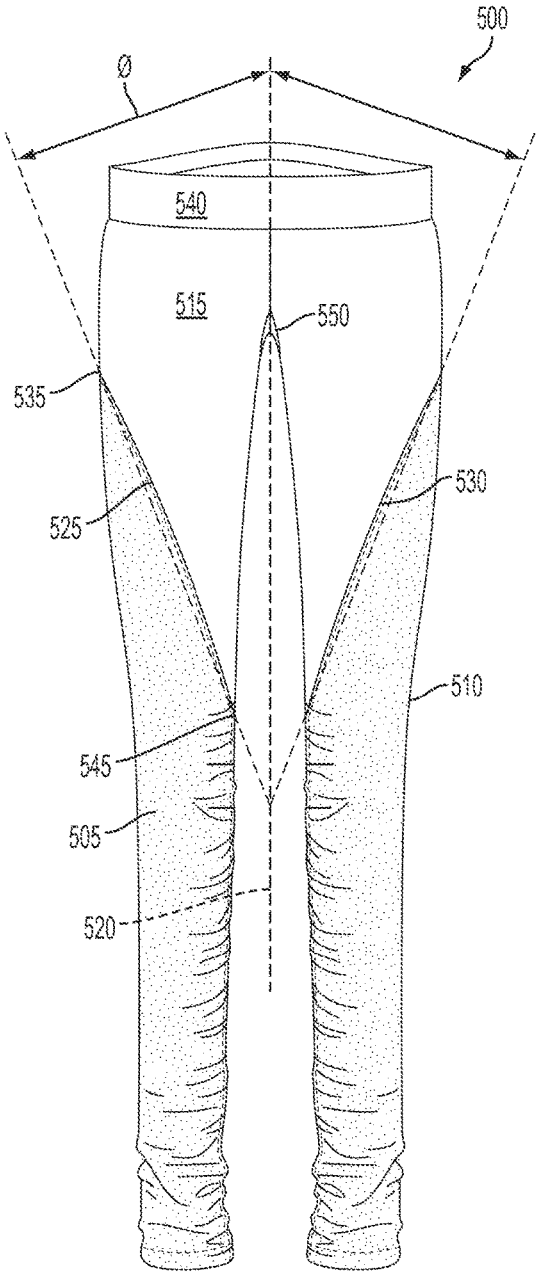
FIG. 5A is a front elevational view of an alternative embodiment of a pair of pants with integrated legwarmers, with angled connection seams.
Figure 5B:
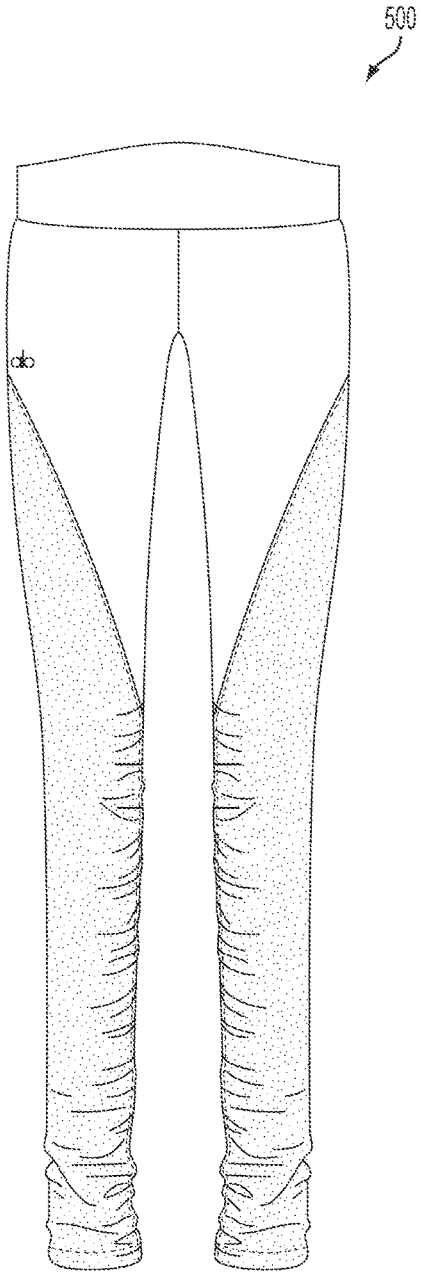
FIG. 5B is a rear elevational view of an alternative embodiment of a pair of pants with integrated legwarmers, with angled connection seams.

FIGS. 5A and 5B collectively illustrate another example embodiment of a pair of pants 500. In this embodiment, legwarmers 505 and 510 are joined to an upper segment 515 of the pants 500 at angles so as to create a visually appealing form. For example, legwarmer 505 is joined to the upper segment 515 at an angle Ø. In some instances, the angle Ø can be measured relative to an inseam reference line 520. The legwarmer 510 would have an angle that is opposite that of angle Ø.

The angle Ø tapers, in some embodiments, from an outer edge 535 of the legwarmer 505 to an inner edge 545 of the legwarmer 505.

The legwarmers 505 and 510 are each joined to the upper segment 515 using connection seams. In some embodiments, the connection seams are arcuate. For example, connection seams 525 and 530 each form an arcuate pattern, creating an arc from the top (outer edge) 535 towards the bottom (inner edge) 545 of the connection seam.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A pair of outerwear pants, comprising:

an upper segment formed from an elastomeric material, the upper segment comprising a leg portion configured to cover at least a portion of legs of a wearer of the pair of pants and a waist portion configured to cover at least a portion of a torso of the wearer of the pair of pants; and a lower segment attached to the upper segment by a stitched connecting seam on each leg, the lower segment formed from a second material having a different knitting pattern than the elastomeric material of the upper segment, and the lower segment comprising a pair of legwarmers that are configured to fit snugly around the legs of the wearer, each of the pair of legwarmers being greater in length than the leg portion of the upper segment such that each of the pair of legwarmers is configured to overlap a portion of a foot of the wearer, providing an anti-slip surface for the wearer of the pair of pants, wherein an elastic material is attached along an inside vertical seam or inside edge of each of the legwarmers such that ruching is formed that causes material of each of the legwarmers to gather and form ripples in the material, wherein the ruching is located only along the inside seam or inside edge of each of the pair of legwarmers.

2. The pair of pants according to claim 1, wherein each of the connecting seams is located from approximately five inches to approximately seventeen inches relative to a lower seam of a waistband of the upper segment.

3. The pair of pants according to claim 1, wherein each of the connecting seams is disposed at an angle less than 90 degrees, relative to an inseam of the upper segment.

4. The pair of pants according to claim 3, wherein the angle causes the each of the connecting seams to slant from an outer edge of each of the pair of legwarmers towards an inner edge of each of the pair of legwarmers.

5. A pair of pants, comprising:

an upper segment formed from a first fabric material, the upper segment configured to cover at least a portion of legs of a wearer of the pair of pants; and a lower segment comprising a pair of legwarmers of a second fabric material of a different knitting pattern than the first fabric material, each of the pair of legwarmers joined by stitching to the upper segment, the pair of legwarmers being greater in length than a leg portion of the upper segment of the pair of pants such that each of the pair of legwarmers is configured to overlap a portion of a foot of the wearer, providing an anti-slip surface for the wearer of the pair of pants, each of the pair of legwarmers further comprising ruching only along an inside seam or inside edge of each of the pair of legwarmers that is formed by release of a material that has been stretched and affixed to an inseam of each of the pair of legwarmers causing material along a vertical interior length of each of the pair of legwarmers to gather together and form ripples in the second fabric material.

6. The pair of pants according to claim 5, wherein the pair of legwarmers are fixedly attached to the upper segment using connecting seams that comprises a flat lock seam or straddle stitch.

7. The pair of pants according to claim 6, wherein the connecting seams are located above the knees of the wearer.

8. The pair of pants according to claim 6, wherein the connecting seams are located approximately five to seventeen inches from a lower seam of a waistband of the upper segment.

9. The pair of pants according to claim 5, wherein the pair of legwarmers and the upper segment mate together at connecting seams, wherein the connecting seams are disposed at an angle less than 90 degrees, relative to an inseam of the upper segment.

10. The pair of pants according to claim 9, wherein the connecting seams are arcuate.

11. The pair of pants according to claim 9, wherein the angle causes the connecting seams to slant from an outer edge of each of the pair of legwarmers towards an inner edge of each of the pair of legwarmers.

12. A pair of outerwear pants, comprising:

an upper segment having a vertical inseam and at least one vertical outseam, the upper segment formed from a first material that is elastomeric, the upper segment comprising:

a waist portion covering at least a portion of a torso of a wearer of the pants; and a leg portion attached to the waist portion, the leg portion configured to cover a portion of legs of the wearer of the pair of pants; and a lower segment comprising a pair of legwarmers attached to the upper segment via a stitched connecting seam, wherein the lower segment comprises a single vertical seam and is longer in length than the leg portion of the upper segment such that each of the pair of legwarmers is configured to overlap a portion of a foot of the wearer, providing an anti-slip surface for the wearer of the pair of pants, wherein the lower segment further comprises ruching along the single vertical seam.

13. The pants of claim 12, wherein the lower segment comprises a pair of legwarmers that are configured to fit snugly around the legs of the wearer.

14. The pants of claim 12, wherein the lower segment is formed from a second material having a different knitting pattern than the first material.

15. A pair of outerwear pants, comprising:

an upper segment formed from a first material, the upper segment comprising a leg portion configured to cover at least a portion of legs of a wearer of the pair of pants; and a lower segment attached to the upper segment by a stitched connecting seam on each leg of the pair of outerwear pants, the lower segment formed from a second material having a different fiber content than the first material of the upper segment, and the lower segment comprising a pair of legwarmers that are configured to fit snugly around the legs of the wearer, each of the pair of legwarmers being greater in length than the leg portion of the upper segment such that each of the pair of legwarmers is configured to overlap a portion of a foot of the wearer, providing an anti-slip surface for the wearer of the pair of pants, the lower segment further comprising an elastic material attached to a single vertical seam of each leg of the legwarmers so that ruching is formed that causes material of each of the legwarmers to gather and form ripples, wherein the ruching is located only along an inside seam or inside edge of each of the pair of legwarmers.

16. The pair of pants of claim 15, wherein the connecting seams are arcuate.

17. The pair of pants of claim 15, wherein the upper segment comprises a vertical inseam and at least one vertical outseam, and the lower segment comprises a single vertical seam.

* * * * *